US005437512A

United States Patent [19]

Güll

[11] Patent Number: 5,437,512

[45] Date of Patent: Aug. 1, 1995

[54] TRANSPORT DEVICE FOR SEPARATED SECTIONS OF A CONTINUOUS RECORDING SUBSTRATE FROM A RECORDING MECHANISM

[75] Inventor: Peter Güll, Berlin, Germany

[73] Assignee: Siemens Nixdorf Informationssysteme Aktiengesellschaft, Paderborn, Germany

[21] Appl. No.: 90,210

[22] PCT Filed: Mar. 10, 1992

[86] PCT No.: PCT/EP92/00528

§ 371 Date: Jul. 26, 1993

§ 102(e) Date: Jul. 26, 1993

[87] PCT Pub. No.: WO92/16377

PCT Pub. Date: Oct. 1, 1992

[30] Foreign Application Priority Data

Mar. 12, 1991 [DE] Germany ..... 41 07 899.3

[51] Int. Cl.[6] ..... B41J 11/68

[52] U.S. Cl. ..... 400/621; 83/82; 346/24; 358/304

[58] Field of Search ..... 400/185, 621, 629, 636, 400/636.1; 346/24; 358/304; 83/82

[56] References Cited

U.S. PATENT DOCUMENTS

| | | | |
|---|---|---|---|
| 3,890,893 | 6/1975 | Kodis | 101/93.28 |
| 3,951,252 | 4/1976 | Selke et al. | 400/621 |
| 4,544,293 | 10/1985 | Cranston et al. | 400/621 |
| 4,557,169 | 12/1985 | Kajiya et al. | 83/81 |
| 4,604,632 | 8/1986 | Matsumoto | 400/621 |
| 4,663,638 | 5/1987 | Hirose | 346/24 |
| 4,810,110 | 3/1989 | Myers | 400/185 |

FOREIGN PATENT DOCUMENTS

| | | | |
|---|---|---|---|
| 2343858 | 3/1975 | Germany . | |
| 3202264 | 8/1983 | Germany . | |
| 3418231 | 11/1984 | Germany . | |
| 3522022 | 1/1986 | Germany . | |
| 63-227363 | 9/1988 | Japan | 400/185 |
| 63-302079 | 12/1988 | Japan | 400/185 |
| 63-45226 | 8/1989 | Japan . | |
| 63-268800 | 4/1990 | Japan . | |

OTHER PUBLICATIONS

"Linear-to-Rotary Converter", by R. J. Coles, IBM Technical Disclosure Bulletin, vol. 23, No. 5, Oct. 1980, pp. 2126–2127.

"Paper Cutting Attachment for Printer", By B. J. Welch et al, IBM Technical Disclosure Bulletin, vol. 14, No. 12, May 1972, pp. 3751–3752.

*Primary Examiner*—David A. Wiecking

*Attorney, Agent, or Firm*—Hill, Steadman & Simpson

[57] ABSTRACT

In a device for transporting sections (28) of a recording substrate from a recording mechanism, the recording mechanism has a cutting unit (12) for separating the sections (28) from the recording substrate. The cutting unit can be moved, in a cutting stroke and in a return stroke, transversely to the direction of transport (A) of the recording substrate across its width. Transport elements (32, 38) for grasping and advancing the separated sections (28) are disposed behind the cutting station in the direction of transport (A) and can be coupled by means of a gear arrangement (14, 24, 52, 50, 44, 36) to the cutting unit (12) in such a way that, upon the return stroke of the cutting unit (12), they grasp the separated section (28) and advance it in the direction of transport (A).

7 Claims, 1 Drawing Sheet

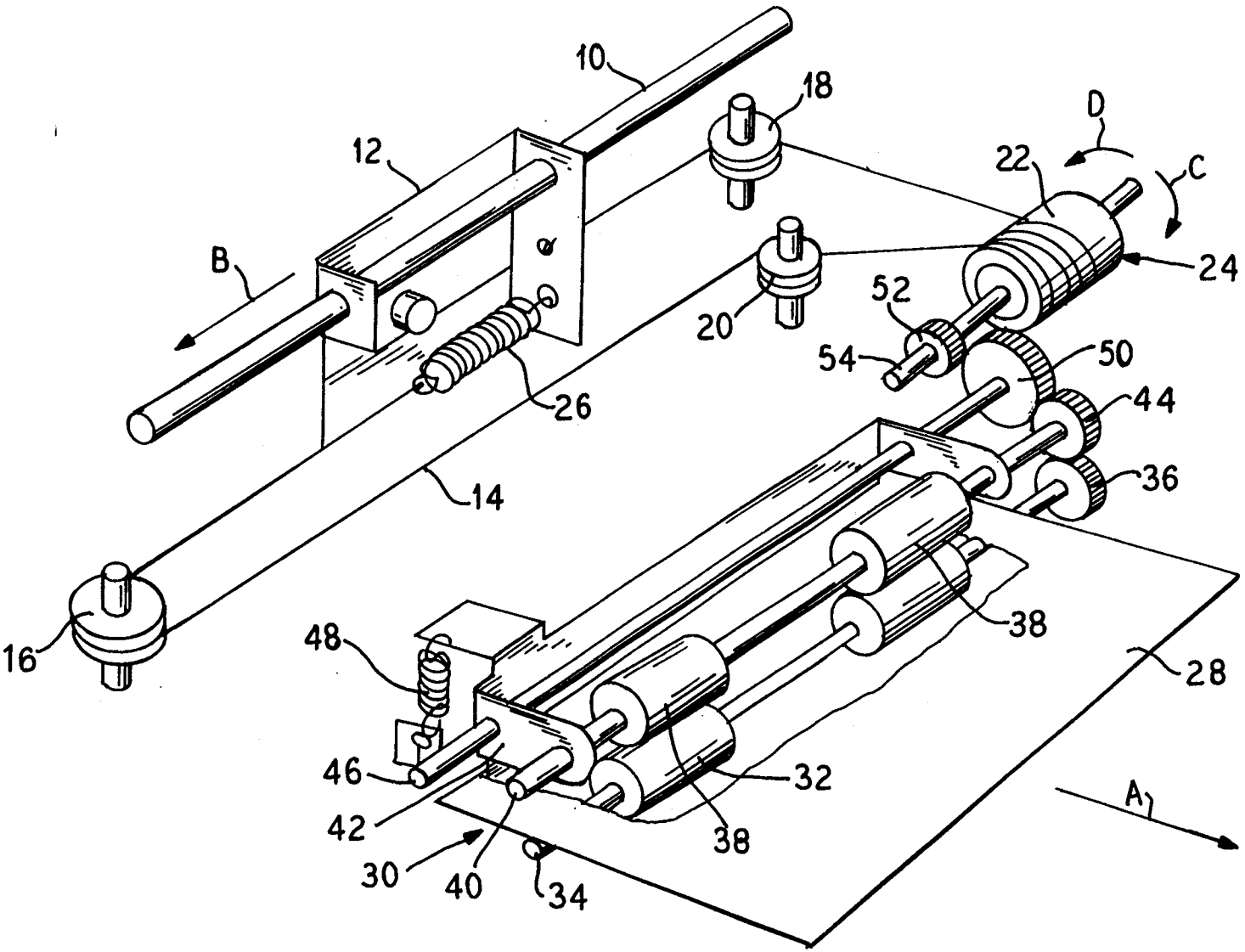
10
12
14
16
18
20
22
24
26
28
30
32
34
36
38
38
40
42
44
46
48
50
52
54
A
B
C
D

TRANSPORT DEVICE FOR SEPARATED SECTIONS OF A CONTINUOUS RECORDING SUBSTRATE FROM A RECORDING MECHANISM

BACKGROUND OF THE INVENTION

The invention relates to a device for transporting separated sections of a continuous recording substrate from a recording mechanism.

A device of this type is known from IBM Technical Disclosure Bulletin Vol. 14, No. 12, May 1972, pages 3751 and 3752. In this, the separated sections are grasped by means of a dedicated transport device and transported away to the side. The transport device is driven, via a complicated, mechanical transmission mechanism, by the constantly revolving drive shaft of the recording mechanism.

From German reference DE-A-23 43 858, (corresponding to U.S. Pat. No. 3,951,252) a device for transporting sections of a recording substrate from a recording mechanism is known, the recording mechanism having a cutting unit for separating the sections from the recording substrate, which cutting unit can be moved, in a cutting stroke and a return stroke, transversely to the direction of transport of the recording substrate across its width. The prior art document, however, contains no references as to how the separated sections can be transported or issued following the cutting operation.

German reference DE-A-35 22 022 (corresponding to U.S. Pat. No. 4,663,638) shows a printing mechanism having a blade connected downstream from the printing area and having a plurality of pairs of offtake rollers for the sections. The type of blade is not however described in detail. Nor can it be deduced from this prior art document whether the drives for the blade and for the offtake roller pairs are interactive.

German reference DE-A-32 02 264 shows a paper-cutting device in which a cylindrical rotary blade extending across the entire printer width is moved by the same drive motor as the paper transport roller. In the one direction of rotation the blade is driven and in the opposite direction of rotation the transport roller is driven. A freewheeling mechanism is assigned to both drives.

SUMMARY OF THE INVENTION

The object of the invention is to specify a device of the type stated in the introduction, in which the separated sections can be removed automatically from the recording mechanism by simple means.

This object is achieved by to a device according to the present invention for transporting separated sections of a continuous recording substrate from a recording mechanism. The recording mechanism has a cutting unit for separating the sections from the recording substrate, which cutting unit can be moved, in a cutting stroke and in a return stroke, transversely to the direction of transport of the recording substrate back and forth across its width. The device has transport elements which are disposed behind the cutting station in the direction of transport and which are drivable to create a motion grasping the separated section and to create a transporting motion for the advancement of the separated section. The transport elements are coupled by means of a gear arrangement to the cutting unit in such a way that they can be driven, both for the grasping motion and for the transporting motion, by the return stroke of the cutting unit.

This arrangement has two basic advantages. Firstly, no dedicated drive motor is required for the transportation of the separated sections. Rather, the motion of the cutting unit in its return stroke is utilized to move the transport elements and, through them, the separated sections. Secondly, there is no need for any dedicated control system governing a drive for the transport elements. These are unavoidably moved only once the cutting operation is completed, thereby enabling the separated section to be removed from the recording mechanism without any problems.

This type of coupling of the transport elements to the cutting unit can be simply realized by the gear arrangement comprising a one-way clutch, for example a freewheeling mechanism. This enables the transport elements to be permanently connected to the cutting unit. Provided that the freewheeling mechanism is suitably installed, upon the cutting stroke of the cutting unit, the motion of said cutting unit is not transmitted to the transport elements, whereas, upon the return stroke, the freewheeling mechanism locks and transmits the motion of the cutting unit to the transport elements.

The coupling between the cutting unit and the transport elements is made possible, in a simple manner, by the fact that the cutting unit has a carrier for a blade, which carrier is displaceably guided transversely to the direction of transport and is connected to the one-way clutch by a control cable which is wrapped, at least partially, around a drive element of the one-way clutch. In order to ensure a secure frictional connection between the control cable and the drive element of the one-way clutch, a tension spring can be disposed in the control cable, which tension spring ensures a suitable pretensioning of the control cable, even without any laborious adjustment of the pretensioning.

Expediently, the transport elements are formed by transport rollers which interact in pairs and can be driven in opposite directions and which form a roller gap for the separated sections of the recording substrate.

In order to ensure that the section to be separated can be introduced without problems between the transport rollers, one of the transport rollers of the or each roller pair is mounted on a rocker which is mounted pivotably about a swivel axis parallel to the roller axis and is pretensioned into its position remote from the respective other transport roller. In this case, means are provided which move the transport rollers of the roller pair onto each other as they are driven by the cutting unit. As long as the transport rollers are not driven, therefore, they are raised apart, so that the section to be separated can be inserted without friction between the transport rollers. If, upon the return stroke of the cutting unit, the transport rollers are to be driven, then the transport roller mounted on the rocker is pressed by a pivoting of the rocker against the fixed transport roller. The section to be separated is consequently grasped and advanced by the transport rollers.

The adjustment of the rocker and power transmission to the transport rollers can be simply realized by the gear arrangement having an intermediate gearwheel which is disposed coaxially to the swivel axis of the rocker and which mates, on the one hand, with a gearwheel connected in a rotationally secure manner to a power take-off element of the one-way clutch and, on the other hand, with a gearwheel which is connected in a rotationally secure manner to the shaft of the transport roller mounted in the rocker and is designed to engage with an identical gearwheel seated on the shaft of the other transport roller. As a result of a rotation of the intermediate wheel, which is in constant engagement with the gearwheel connected in a rotationally secure manner to the transport roller mounted on the rocker, the rocker is initially pivoted until the transport roller mounted therein bears against the other transport roller or against the section situated between the two rollers. Since the rocker cannot now yield any further, the torque of the intermediate gearwheel is transmitted to the transport rollers, which eject the separated section.

BRIEF DESCRIPTION OF THE DRAWING

The features of the present invention which are believed to be novel, are set forth with particularity in the appended claims. The invention, together with further objects are advantages, may best be understood by reference to the following description taken in conjunction with the accompanying drawing, and in which:

The single figure shows a perspective, diagrammatical representation of the transport device according to the invention.

DESCRIPTION OF THE PREFERRED EMBODIMENT

In the figure, a guide rod 10 can be seen, which is held in a frame (not represented) of a recording mechanism, for example a voucher printer, and extends transversely to the direction of transport, denoted by the arrow A, for a recording substrate. The printing head and other parts of the recording mechanism are not represented. They can be configured, for example, in the form as represented in U.S. Pat. No. 3,951,252 hereby incorporated by reference and corresponding to German reference 23 43 858. Mounted displaceably on the guide rod 10 is a blade carriage 12, on which a roller blade (not represented) is mounted. Suspended from the blade carriage 12 is a thin cable 14, which is guided by means of three deflection pulleys 16, 18, 20 and is wrapped, with a plurality of windings, around a cylindrical, sleeve-shaped drive element 22 of a freewheeling mechanism denoted, in general terms, by 24. In order to pretension the cable 14 such that a slip-free power transmission is guaranteed between the cable 14 and the sleeve 22, a tension spring 26 is disposed between the one end of the cable and the blade carrier 12.

The advancement of the separated section 28 of a continuous recording substrate (not otherwise represented) is served by a transport device denoted, in general terms, by 30. This has lower transport rollers 32, which are seated in a rotationally secure manner on a fixedly mounted shaft 34 supporting, at one of its ends, a gearwheel 36.

Interacting with these lower transport rollers 32 are two upper transport rollers 38 which are seated in a rotationally secure manner on a shaft 40, the shaft 40 being rotatably mounted in a rocker 42 and supporting at its one end a gearwheel 44 which is designed to engage with the gearwheel 36. The rocker 42 is pivotable about a swivel shaft 46 parallel to the shafts 34, 40 and is mounted, sliding with friction on the said swivel shaft, in the frame of the recording mechanism and is pretensioned by a tension spring 48 into a position in which the upper transport rollers 38 are raised from the lower transport rollers 32. In this position, the section 28 to be separated can be introduced, without obstruction, into the gap between the lower and upper transport rollers 32 and 38 respectively.

The swivel shaft 46 supports at its one end an intermediate gearwheel 50 which is in constant engagement with the gearwheel 44 on the upper transport roller shaft 40 and is likewise constantly mated with a gearwheel 52 seated on the power take-off shaft 54 of the freewheeling mechanism 24. As can be seen, the gearwheels 44, 50 and 52 remain in constant reciprocal engagement under this arrangement, even in the event of a pivoting motion of the rocker 42. The gearwheels 44 and 36 on the transport roller shafts have the same diameter. The diameters of their reference circles correspond to the outer diameters of the rollers 32 and 38 respectively.

The device so far described operates as follows:

Following the conclusion of a printing operation, during which the blade carriage 12 is located in a rest position (situated on the right in the figure) outside the motional path of the printing head, the printing head (not represented) travels beyond the end of its normal motional path and is thereupon automatically coupled to the blade carriage 12. Upon an opposite motion, the printing head then drags the blade carriage, in a cutting stroke, in the direction of the arrow B, transversely across the recording substrate, the roller blade (not represented) separating the printed section 28 from the recording substrate. Upon this motion, the sleeve 22 of the freewheeling mechanism 24 is freely rotated, by means of the cable 14, in the direction of the arrow C. The power take-off shaft 54 is not thereupon jointly moved, so that the transport device 30 too remains at rest. The printing head and the blade carriage 12 still connected to it then return in a return stroke, counter to the direction of the arrow B, into the home position, in which the connection between the printing head and the blade carriage is automatically re-released, as is described, for example, in U.S. Pat. No. 3,951,252 corresponding to German reference 23 43 858. In place of the electromechanical clutch described therein, a purely mechanical clutch could also be provided, which automatically engages as the printer carriage drives up against the blade carriage and is automatically re-released when the blade carriage is delivered in its rest position.

Upon the return stroke of the blade carriage, the sleeve 22 of the freewheeling mechanism 24 is moved by the cable 14 in the direction of the arrow D. In this position, the freewheeling mechanism 24 locks, so that the rotary motion of the sleeve 22 is transmitted to the power take-off shaft 54 of the freewheeling mechanism 24.

The rotary motion of the power take-off shaft 54 is transmitted via the gearwheel 52 to the intermediate gearwheel 50 and from this to the gearwheel 44. In this case the rocker 42, which has been raised by the tension spring 48, is initially pivoted downwards, until the upper transport rollers 38 bear upon the separated section 28 and press this against the lower transport rollers 32. In this case the gearwheels 44 and 36 enter into reciprocal engagement, so that the lower transport rollers and the upper transport rollers are now driven at the same speed, yet in opposite directions of rotation, and remove from the recording mechanism, in the direction of the arrow A, the separated section which is grasped between them. In the instant at which the blade carriage 12 has regained its home position and no torque is being transmitted via the freewheeling mechanism 24, the tension spring 48 re-raises the rocker 42, so that, upon the further advancement of the recording substrate, its front edge can again be inserted comfortably between the lower and upper transport rollers.

The above description shows that not only can the cutting unit be moved by the drive motor for the printing head carriage, but that the return motion of the cutting unit can also be used to drive a transport device for the separated section. This gives rise to an inexpensive and space-saving device for the automatic ejection of a separated section from the recording mechanism.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A device for transporting separated sections of a continuous recording substrate from a recording mechanism, comprising: said recording mechanism having a cutting unit for separating sections from the recording substrate, which cutting unit is movable, in a cutting stroke and in a return stroke, transversely to a direction of transport of the recording substrate back and forth across a width of the recording substrate; transport elements disposed downstream of the cutting unit which can be moved together to create a driving nip for a respective separated section and to create a transport motion for advancement of the separated section; the transport elements coupled by means of a gear arrangement to the cutting unit such that the transport elements are moved by the return stroke of the cutting unit to create the driving nip and transport separated section.

2. The device as claimed in claim 1, wherein the gear arrangement comprises a one-way clutch.

3. The device as claimed in claim 2, wherein the one-way clutch is a freewheeling mechanism.

4. The device as claimed in claim 2, wherein the cutting unit comprises a carrier for a blade, which carrier is displaceably guided transversely to the direction of transport, and wherein the carrier is connected to the one-way clutch by a control cable which entwines, at least partially, a drive element of the one-way clutch which forms a part of the gear arrangement.

5. The device as claimed in claim 4, wherein the control cable includes a tension spring disposed to tension said control cable.

6. The device as claimed in claim 1, wherein the transport elements are transport rollers which interact in pairs that are drivable in opposite directions and which form a roller gap for grasping separated sections of the recording substrate.

7. The device as claimed in claim 6, wherein one transport roller of the transport rollers interacting in pairs is mounted on a rocker, which is in turn mounted pivotably about a swivel axis parallel to roller axes of the transport rollers and is pretensioned a position remote from a respective other, fixedly mounted transport roller of the transport rollers, and wherein the gear arrangement has an intermediate gearwheel, which is disposed coaxially to the swivel axis of the rocker and which mates with a further gearwheel connected in a rotationally secure manner to a drive element of the one-way clutch and which also mates with a first gearwheel which is connected in a rotationally secure manner to the shaft of the one transport roller mounted in the rocker and is engageable with a second gearwheel substantially identical to said first gearwheel said second gearwheel seated on a shaft of the other transport roller.

* * * * *